US006296540B1

(12) United States Patent
LaPlaca et al.

(10) Patent No.: US 6,296,540 B1
(45) Date of Patent: Oct. 2, 2001

(54) CONTAINER, CHARACTER TOY, AND TOY COMBINATION

(75) Inventors: Paul J. LaPlaca, Bethel; Charles Zunda, Wilton, both of CT (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/129,543

(22) Filed: Aug. 5, 1998

(51) Int. Cl.[7] ..... A63H 33/04
(52) U.S. Cl. ..... 446/75; 446/76; 446/77
(58) Field of Search ..... 446/69, 71, 72, 446/73, 74, 76, 77, 79, 81, 75; 206/457; 229/116.3; 40/411, 421

(56) References Cited

U.S. PATENT DOCUMENTS

| | | | |
|---|---|---|---|
| D. 24,750 | | 10/1895 | Vail . |
| D. 36,262 | | 3/1903 | Bonnert . |
| D. 91,691 | | 3/1934 | Steuer . |
| D. 93,691 | | 10/1934 | Steelman . |
| D. 94,069 | | 12/1934 | Brenner . |
| D. 94,251 | | 1/1935 | Twiggs . |
| D. 104,716 | | 6/1937 | Berkowitz . |
| D. 105,379 | | 7/1937 | Guerlain . |
| D. 120,624 | | 5/1940 | Lowenstein . |
| D. 120,625 | | 5/1940 | Lowenstein . |
| D. 144,569 | | 4/1946 | Karoff . |
| D. 186,120 | | 9/1959 | Henson et al. . |
| D. 192,388 | | 3/1962 | De Kolb . |
| D. 198,945 | | 8/1964 | Plummer . |
| D. 222,842 | | 1/1972 | Merck et al. . |
| D. 230,748 | | 3/1974 | Matteson . |
| D. 242,121 | | 11/1976 | Stoddard . |
| D. 257,124 | | 9/1980 | Grip . |
| D. 279,889 | | 7/1985 | Santa-Eulalia et al. . |
| D. 288,294 | | 2/1987 | Taylor et al. . |
| D. 293,004 | | 12/1987 | Emms . |
| D. 306,692 | | 3/1990 | Ferrero . |
| 1,637,667 | * | 8/1927 | Vaughan ..... 446/73 |
| 1,866,493 | * | 7/1932 | Staats ..... 446/72 |
| 2,096,872 | * | 10/1937 | Baker ..... 446/72 |
| 2,811,805 | * | 11/1957 | Briese ..... 446/72 |
| 3,143,755 | * | 8/1964 | Rowley ..... 446/74 X |
| 3,251,154 | | 5/1966 | Taylor . |
| 3,303,602 | | 2/1967 | Douglas . |
| 3,349,515 | | 10/1967 | Douglas . |
| 3,353,823 | | 11/1967 | Sobel . |
| 3,521,397 | | 7/1970 | Meates . |
| 3,577,676 | | 5/1971 | Powell . |
| 3,986,639 | * | 10/1976 | Zaccaro ..... 446/73 X |
| 4,515,572 | | 5/1985 | Emms . |
| 4,581,904 | * | 4/1986 | Lehmann et al. ..... 446/73 X |
| 4,816,000 | * | 3/1989 | Hsu ..... 446/74 |
| 5,297,980 | * | 3/1994 | Barthold ..... 446/74 X |
| 5,503,274 | | 4/1996 | Toffler et al. . |

OTHER PUBLICATIONS

U.S. Trademark Registration No.: 1,492,832 Registered Jun. 21, 1988.

Front and rear Mr. Bubble labels for a container, rear label showing copyright 1992.

* cited by examiner

*Primary Examiner*—Sam Rimell
(74) *Attorney, Agent, or Firm*—Ohlandt, Greeley, Ruggiero & Perle, LLP

(57) ABSTRACT

A container shaped as a toy raft has a body wall with a member protruding therefrom for mounting a character toy on the member. A character toy has a cavity formed in an exterior portion thereof for positioning the character toy on the member. A toy combination is the character toy mounted on the body wall of the container by the cavity of the character toy being positioned on the member of the container.

18 Claims, 4 Drawing Sheets

CONTAINER, CHARACTER TOY, AND TOY COMBINATION

The present invention relates to a container that can be used as a toy. More particularly, the present invention is directed to a container, and a character adapted to be positioned selectively on the container's cap or on a wall of the container, so that the container and character can be used individually or in combination as a toy.

BACKGROUND OF THE INVENTION

Field of the Invention

Character toys have been used with containers. The bottom surface of such character toys have had an opening or cavity that fits on the cap of the container. The character toy is placed on the cap of the container and sold as a combination. In these toys, the character can only be used on the cap or alone, but not secured in any other fashion to the container.

It would be desirable if the character toy and the container could be associated with each other in a different way and, thus, used as a toy combination.

OBJECTS OF THE INVENTION

It is an object of the present invention to provide such a desired character toy and container that can be used as a toy combination.

It is another object of the present invention to provide such a container that can be used by itself as a toy, and also as a toy combination having the character toy mounted selectively to a body wall of the container.

It is a further object of the present invention to provide such a character toy that can be used by itself as a toy, and that is adapted to be mounted on a body wall of a container so that the two form a second toy.

It is yet another object of the present invention to provide such a character toy that can be used as a squirt toy.

SUMMARY OF THE INVENTION

The present invention includes a container having one or more body walls. Preferably, the body wall(s) include(s) at least one side wall, a front wall and a rear wall. At least one body wall has means, for example, a portion of the body wall, for mounting a character toy thereon. The mounting means preferably includes a member, preferably protruding from preferably a front or rear wall. The protruding member is preferably a circular member that protrudes outwardly from the body wall. The front or rear wall preferably has a recessed panel, and the mounting means is located on the recessed panel.

The container is preferably shaped as a raft. Accordingly, at least one side wall is generally tubularly shaped, and extends about the periphery of the raft. The mounting portion is preferably shaped as an annular life preserver that protrudes outwardly from the recessed panel of the front or rear wall.

The present invention also includes a character toy that can be mounted on a body wall of the container. Preferably, the character toy can be selectively mounted on either the end, i.e., the cap or neck, or on the body wall of the container. The character toy has means for positioning the character toy on the cap or neck, or on the body wall. The positioning means may include a cavity formed in an exterior portion, e.g., in the bottom surface, of the character toy. The cavity may have a circular shape. The cavity may have a recessed portion adapted for positioning the character toy on the cap or neck of the container, and an entrance portion communicating with the recessed portion and the surface. The entrance portion is adapted for positioning the character toy on the mounting means of the container body wall.

The present invention also includes a toy combination comprising the container having a character toy mounted on a body wall of the container. The character toy can be a squirt toy.

DETAILED DESCRIPTION OF THE PREFERRED EMBODIMENTS

Figure 1:
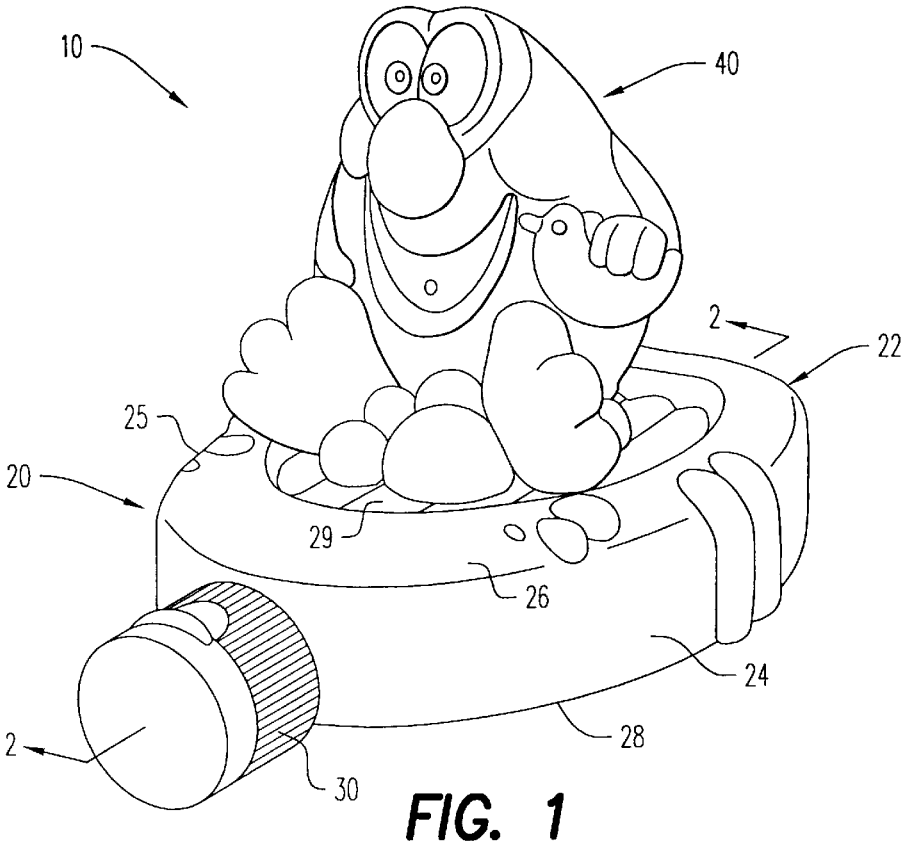
FIG. 1 is a perspective view of a toy combination of the present invention.
Figure 2:
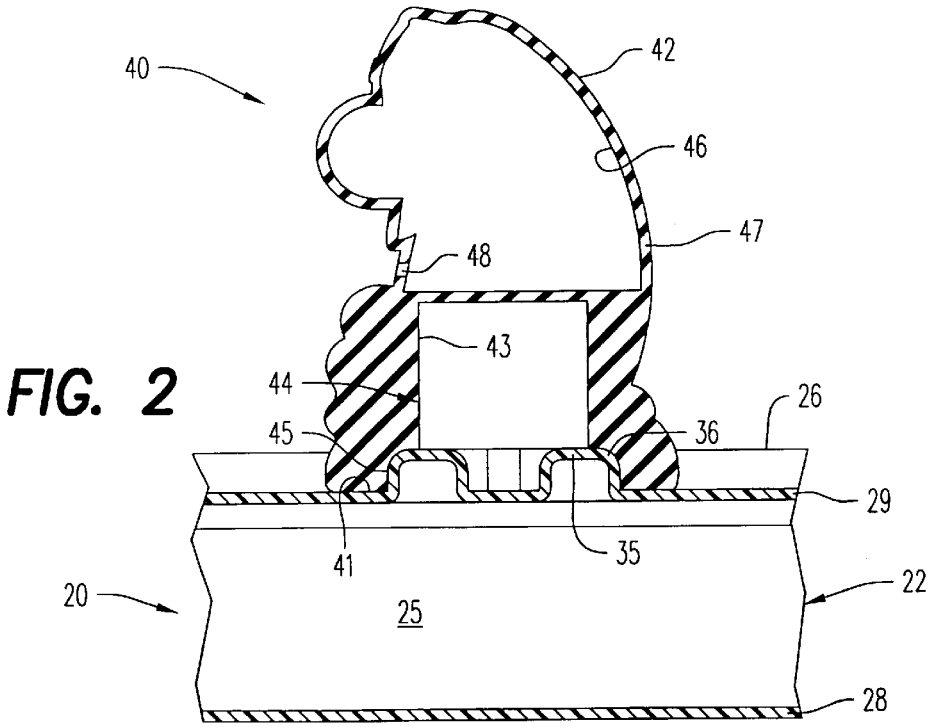
FIG. 2 is a vertical sectional view, with portions broken away, taken along line 2—2 of FIG. 1.
Figure 3:
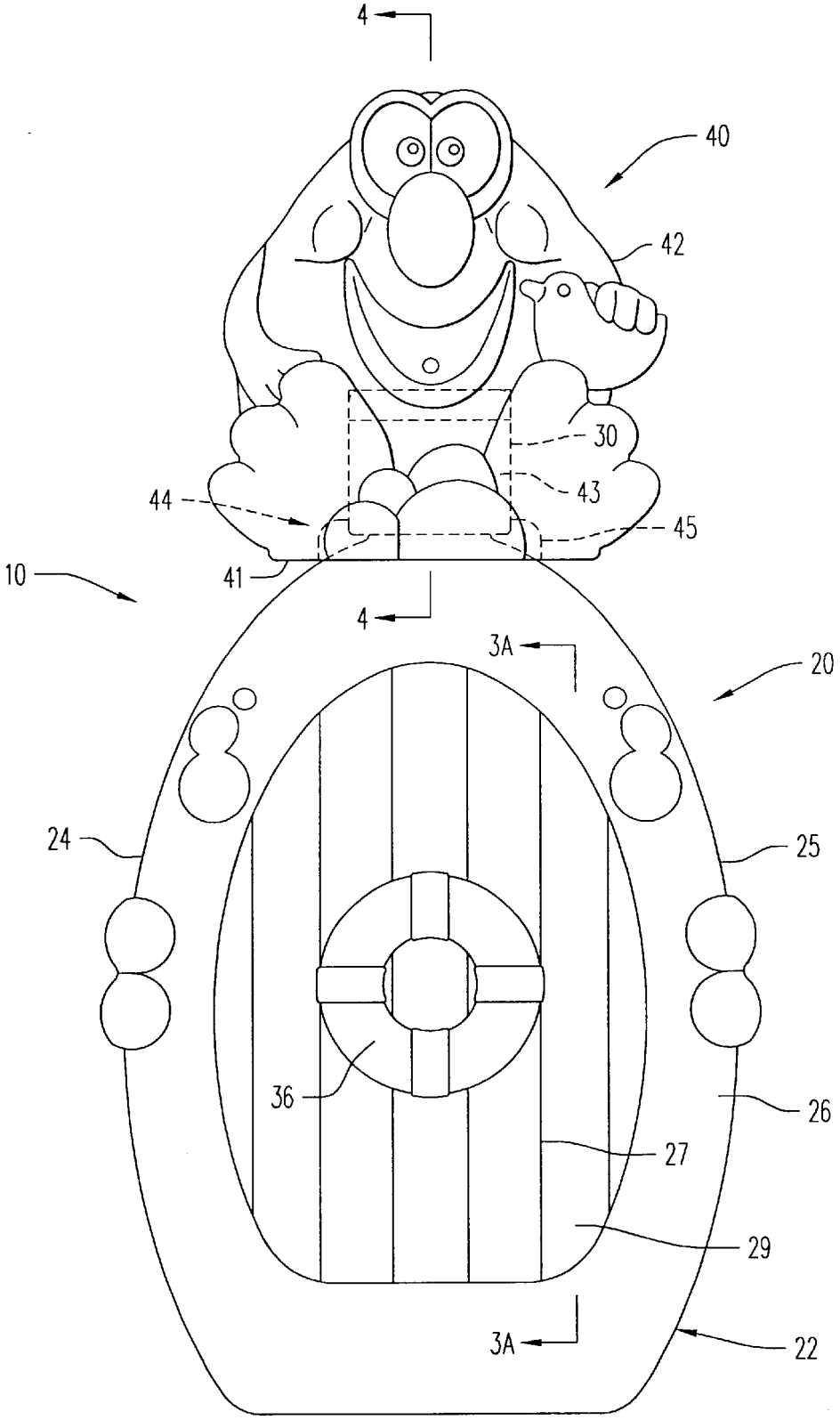
FIG. 3 is a front elevational view of a toy character of the present invention placed on the cap of a container of the present invention.
Figure 3A:
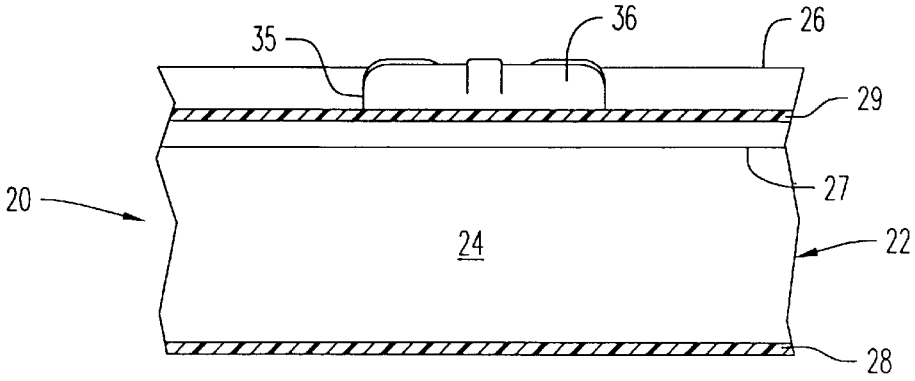
FIG. 3A is a side vertical sectional view, with portions broken away, taken along line 3A—3A of FIG. 3.

Referring to the drawings and, in particular, FIG. 1, there is shown a preferred combination toy of the present invention generally represented by reference numeral 10. The toy includes a container 20 having a character toy 40 placed thereon. The container 20, shown in the form of a bottle, has a body wall 22 with a neck (not shown) having a cap 30 threaded or otherwise secured thereto. The body wall 22 can have any configuration and number of sides, although it is preferred that the body wall have one or more side walls 24, 25, a front wall 26 and a rear wall 28. As shown in FIGS. 2 through 3A, container 20 is preferably shaped as a raft whose side walls 24, 25 are each axially, arcuately shaped. The front and rear portions of side walls 24, 25 are preferably circumferentially generally tubularly shaped and extend basically about the periphery of container 20. The front wall 26 and rear wall 28 each include a recessed panel 29 (the recessed panel in rear wall 28 is not shown). One of front or rear walls 26, 28 includes means for mounting character toy 40 to or on body wall 22. The mounting means can, for example, include a member 35, shown in the form of a circular life preserver 36, that protrudes outwardly from recessed panel 29 of front wall 26.

The character toy 40 has a body 42 that includes means, preferably shown as a cavity 44, having an entrance or entrance portion 45, that is adapted to receive and position character toy 40 on life preserver 36 of container 20. Although entrance 45 is shown as formed in a bottom surface 41 of character toy 40, the entrance and/or cavity 44 can be formed in, i.e., extend into, any exterior portion or surface of body 42. The cavity 44 preferably also includes a recessed portion 43 that is adapted to receive and removably place character toy 40 on the end, i.e., on cap 30 or on the neck, of container 20. As shown, entrance portion 45 preferably is larger than and concentric with recessed portion 43.

Figure 5:
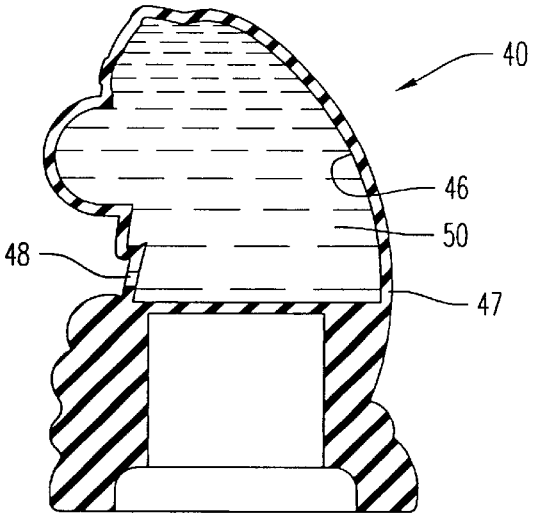
FIG. 5 is a vertical sectional view of the character toy of FIG. 2 having a liquid therein.
Figure 6:
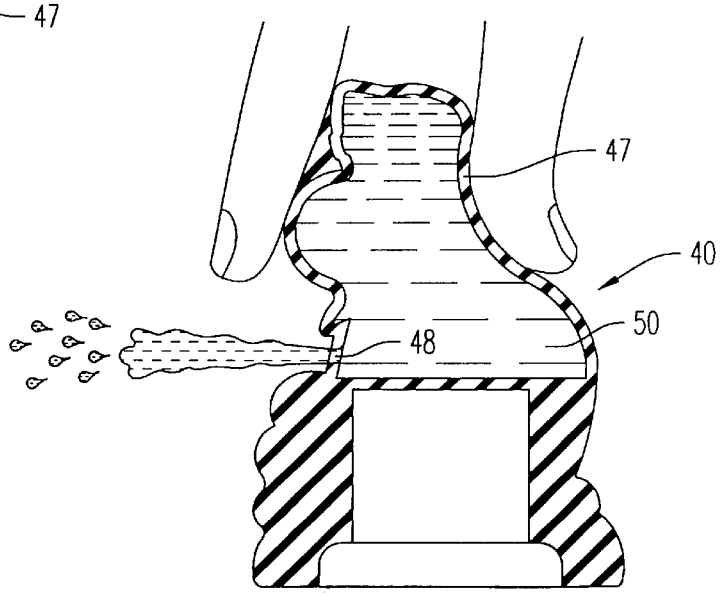
FIG. 6 shows the character toy of FIG. 5 being squeezed and emitting liquid therefrom.

Referring to FIG. 2, character toy 40 preferably has a chamber 46 for holding a liquid 50 (FIGS. 5 and 6). The liquid 50 can enter and exit chamber 46 through a small hole 48 in chamber wall 47. The small hole 48 may close upon itself to avoid leakage of liquid 50 from chamber 46.

Referring to FIG. 3, recessed portion 43 of cavity 44 is shown matingly engaging cap 30. The recessed portion 43 is adapted to selectively and removably place character toy 40 on container 20. FIG. 3 shows that cavity 44 has recessed portion 43 and entrance portion 45. These portions preferably are each cylindrical in order to mate with life preserver 36 of recessed panel 29, which life preserver has a circular, annular shape.

As shown in FIG. 3A, life preserver 36 protrudes upwardly from recessed panel 29 of front wall 26. The recessed panel 29 is preferably fluted, and has creases 27 therein to enhance the appearance of container 20 as a toy raft. Although not shown, rear wall 28 of container 20 has a recessed panel that can provide an air pocket under the container or raft to help it float.

Figure 4:
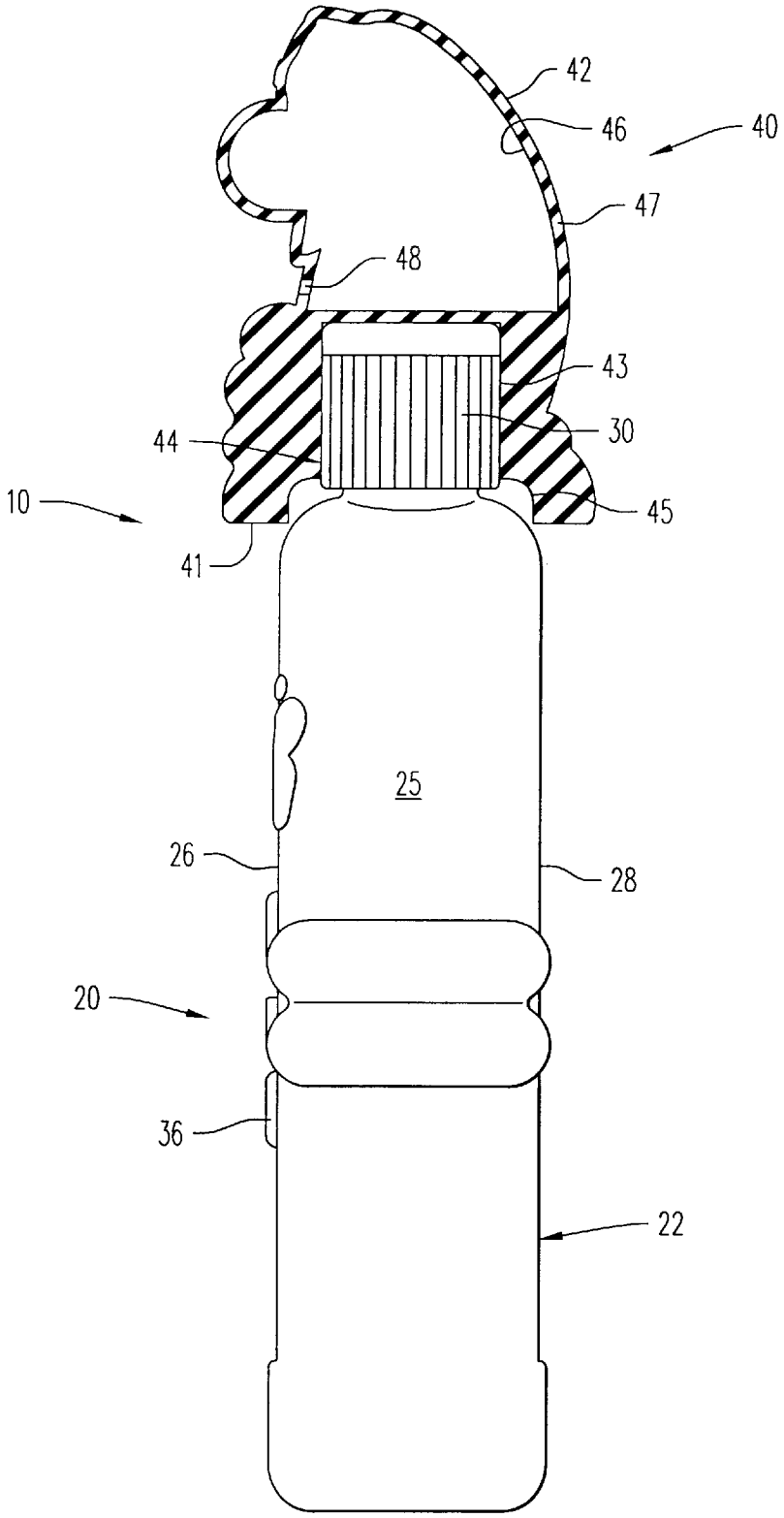
FIG. 4 is a partial side elevational view taken along line 4—4 of FIG. 3.

FIG. 4 illustrates that life preserver 36 protrudes beyond the surface of front wall 26.

Referring to FIGS. 5 and 6, character toy 40 can be a squirt toy. As shown in FIG. 5, character toy 40 has a chamber 46 that can be filled with liquid 50, such as water. For this use, chamber wall 47 of character toy 40 preferably is made of a flexible material. When chamber 46 is empty, chamber wall 47 can be squeezed and released to draw liquid through hole 48 into the chamber. As shown in FIG. 6, chamber wall 47 can be squeezed to emit a stream of water 50 through hole 48.

Having described the preferred embodiments of container 20 and character toy 40 of the present invention, it can be seen that they are useful as toys in themselves, and when selectively joined together as a toy combination 10 in accordance with the present invention. The container 20, configured as a toy life raft or boat, can float in a tub or basin. Whether toy character 40 is placed or placeable on the cap or neck of container 20 when the character toy is purchased, it has means to position, mount, or attach the toy character to body wall 22 of the container to form a toy combination. Thus, character toy 40 can ride on and be carried with container or raft 20 without falling off. The character toy 40 can be employed alone as a squirt toy, and also when it is placed on the cap or mated with mounting member 35 of container or raft 20.

The container 20 can be made of any suitable material. Preferably, it is made of a lightweight polymeric material, such as an ethylene or propylene polymer or copolymer, or combination of the same. The material should provide the mounting member 35 of body wall 22 with sufficient rigidity to mount and retain character toy 40 on the mounting member, yet permit the user to readily remove the character toy from the body wall.

According to the present invention, body wall 22 with which the mounting member 35 is associated, can be any wall or structure of container 20 other than its cap or neck.

The mounting member 35 associated with body wall 22 of container 20 can be any suitable, safe structure for positioning or mounting character toy 40 to or on the body wall. Likewise, the positioning structure associated with character toy 40 can be any suitable structure for positioning the character toy to or on body wall 22. For example, the positioning structure may be or may include an elongated member that is within a cavity in or that extends from the bottom of character toy 40. Also, the mounting member 35 may be or may include a mating indentation or socket in or extending from a portion of body wall 22 of container 20. Suitable positioning structures and mounting members can be or include any set of cooperable structures that employ a friction fit, threaded, bead and groove, snap-in, hook and loop or other inter-engaging arrangement.

The character toy 40 can have any shape or configuration and can be made of any suitable material. When used as a squirt toy, character toy 40 preferably, at least chamber wall 47, is comprised of a flexible, preferably elastomeric or polymeric material.

The particular container 20 shown in the drawings has integral, protruding, rounded items molded on its surface. These represent bubbles since container 20 is designed for containing a bubble bath liquid. The particular character toy 40 shown is a particular character design, shown sitting astride representations of bubbles, and is a trademark of Playtex Products, Inc.

Wherefore we claim:

1. A container, comprising:

a toy; and a body wall having an end portion and a first means for mounting said toy thereon, said first mounting means being at said body wall, said end portion having a central axis, said first mounting means having a central axis that is offset from said central axis of said end portion, said end portion having a second means for mounting a said toy thereon;

wherein said toy can be selectively mounted on either said first mounting means or said second mounting means.

2. The container of claim 1, wherein said first mounting means has a cylindrical shape.

3. The container of claim 1, wherein said body wall has a pair of opposite walls, and wherein said first mounting means is associated with one of said pair of opposite walls.

4. The container of claim 3, wherein at least one of said pair of opposite walls has a recessed panel.

5. The container of claim 1, wherein said toy engagable with a said container comprises a means for selectively engaging a first mounting means member located on a body wall of said container having a first central axis, a second mounting means located on an end portion of said container having a second central axis, wherein said first central axis is substantially perpendicular to said second central axis.

6. The container of claim 5, wherein the toy has a wall that defines a chamber and has a hole therethrough, so that that the toy can be used as a squirt toy.

7. The container of claim 5, wherein said engaging means comprises a cavity formed in said toy.

8. The container of claim 7, wherein said cavity has an entrance portion communicating with a recessed portion, said first mounting means has a first outwardly protruding member, said second mounting means having a second outwardly protruding member, whereby said entrance portion is adapted to be seated on said first outwardly protruding member, and said recessed portion is adapted to be seated on said second outwardly protruding member.

9. The container of claim 8, wherein said recessed and said entrance portions of said cavity are concentric.

10. The container of claim 8, wherein said entrance portion is larger than said recessed portion.

11. The container of claim 8, wherein said toy has a bottom surface, and wherein said bottom surface has said entrance portion formed therein.

12. A container, comprising:

a body wall having a pair of opposite walls, an end portion, and first and second means for mounting a toy, at least one of said pair of opposite walls having a recessed panel, said first mounting means having a first member that protrudes outwardly from said body wall, said second mounting means having a second member that protrudes outwardly from said end portion, wherein said first mounting means is located on said recessed panel, and wherein said second means for mounting is located on said end portion.

13. A container, comprising:

a body wall having a pair of opposite walls, an end portion, and first and second means for mounting a toy, said first mounting means having a first member that protrudes outwardly from said body wall, said second mounting means having a second member that protrudes outwardly from said end portion, wherein said second means for mounting is located on said end portion, and wherein said body wall has at least one side wall that connects together said pair of opposite walls, said side wall extending about the periphery of said container, wherein said container is shaped as a raft, and said first outwardly-protruding member is in the form of an annular life preserver.

14. A toy combination, comprising a toy; and a container having a first means for mounting said toy thereon, and a second means for mounting said toy thereon, wherein said first mounting means has a first outwardly extending member and said second mounting means has a second outwardly extending member, said toy having means for selectively engaging said first mounting means or said second mounting means, wherein said toy is configured such that a complete version of said toy can only be mounted to one of said first and second mounting means at a time.

15. The toy combination of claim 14, wherein said body wall includes a pair of opposed walls, and wherein said mounting means is associated with one of said pair of opposed walls.

16. A toy combination comprising:

a container having a body wall having a pair of opposite walls, an end portion, first and second means for mounting a toy, said first mounting means having a first member that protrudes outwardly from said body wall, said second mounting means being located on said end portion, said second mounting means having a second member that protrudes outwardly from said end portion, wherein at least one of said pair of opposed walls has a recessed panel, and wherein said first mounting means is located on said recessed panel; and a toy having a means for selectively engaging said first mounting means and said second mounting means.

17. A toy combination, comprising:

a container having a body wall, said body wall having an end portion and first and second means for mounting a toy, said first mounting means having a first member that protrudes outwardly from said body wall, said second mounting means having a second member that protrudes outwardly from said end portion; and a toy having means for engaging the container on either one of said firs t and second means for mounting, wherein the container is shaped as a raft, wherein said end portion has an opening and said second member is a means for covering said opening, and wherein said member is shaped as an annular life preserver.

18. The combination of claim 17, wherein said seating means includes a cavity, said cavity having an entrance portion adapted to seat said character toy on said outwardly-protruding, annular life preserver, said entrance portion in communication with a recessed portion adapted to seat said toy on said outwardly-protruding covering means.

* * * * *